US007940005B1

(12) United States Patent
Smith

(10) Patent No.: US 7,940,005 B1
(45) Date of Patent: May 10, 2011

(54) COOLED PHOTOCATHODE STRUCTURE

(75) Inventor: Arlynn Walter Smith, Blue Ridge, VA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 608 days.

(21) Appl. No.: 11/936,915

(22) Filed: Nov. 8, 2007

(51) Int. Cl.
*H01J 40/06* (2006.01)

(52) U.S. Cl. ..... 313/544; 313/532; 313/535; 313/542; 313/103 R; 313/103 CM

(58) Field of Classification Search ..... 313/532–536, 313/542, 544, 103 R, 103 CM
See application file for complete search history.

(56) References Cited

U.S. PATENT DOCUMENTS

| | | | | |
|---|---|---|---|---|
| 3,751,709 | A * | 8/1973 | Wilson et al. | 315/50 |
| 3,757,151 | A * | 9/1973 | Ace | 313/39 |
| 3,814,964 | A * | 6/1974 | Ace | 313/39 |
| 5,029,963 | A | 7/1991 | Naselli et al. | |
| 5,084,780 | A | 1/1992 | Phillips | |
| 5,912,500 | A * | 6/1999 | Costello et al. | 257/434 |
| 6,121,612 | A * | 9/2000 | Sinor et al. | 250/330 |
| 6,376,984 | B1 * | 4/2002 | Fernandez et al. | 313/530 |
| 6,765,352 | B2 * | 7/2004 | Ohtomo et al. | 313/542 |
| 7,129,464 | B2 * | 10/2006 | Buchin | 250/214 VT |
| 2003/0146698 | A1 * | 8/2003 | Ohtomo et al. | 313/542 |
| 2006/0081770 | A1 * | 4/2006 | Buchin | 250/214 VT |

FOREIGN PATENT DOCUMENTS

JP 62180930 A * 8/1987

* cited by examiner

*Primary Examiner* — Nimeshkumar D Patel
*Assistant Examiner* — Thomas A Hollweg
(74) *Attorney, Agent, or Firm* — RATNERPRESTIA

(57) ABSTRACT

A photocathode for an image intensifier tube includes a faceplate, a glass plate disposed opposite the faceplate, and a span having one end attached to the glass plate and the other end attached to the faceplate for forming a sealed chamber between the faceplate and the glass plate. A semiconductor layer is bonded to a surface of the glass plate, where the surface is disposed outside of the sealed chamber. The semiconductor layer forms a photocathode. A thermal electric cooler (TEC) is disposed inside the sealed chamber for cooling the photocathode. The faceplate is formed from sapphire material. The glass plate is formed from high conductivity glass. The span is formed from either high conductivity glass or low conductivity glass. The faceplate and the glass plate form a path for light to impinge upon the semiconductor layer, and the photocathode of the semiconductor layer is configured to convert the light into electrons for emission toward an electron gain device.

10 Claims, 6 Drawing Sheets

COOLED PHOTOCATHODE STRUCTURE

FIELD OF THE INVENTION

The present invention relates, in general, to image intensifier tubes and, more specifically, to a photocathode structure subjected to cooling.

BACKGROUND OF THE INVENTION

Night vision systems are used in a wide variety of military, industrial and residential applications to enable sight in a dark environment. For example, night vision systems are utilized by military aviators during nighttime flights. Security cameras use night vision systems to monitor dark areas and medical instruments use night vision systems to alleviate conditions such as retinitis pigmentosis (night blindness).

Image intensifier devices are employed in night vision systems to convert a dark environment to an environment perceivable by a viewer. More specifically, the image intensifier device within the night vision system collects tiny amounts of light in a dark environment, including the lower portion of the infrared light spectrum present in the environment, which may be imperceptible to the human eye. The device amplifies the light so that the human eye can perceive the image. The light output from the image intensifier device can either be supplied to a camera, external monitor or directly to the eyes of a viewer. The image intensifier device is commonly employed in vision goggles that are worn on a user's head for transmission of the light output directly to the viewer. Accordingly, since the goggles are worn on the head, they are desirably compact and light weight for purposes of comfort and usability.

Image intensifier devices include three basic components mounted within a housing, i.e. a photocathode (commonly called a cathode), a microchannel plate (MCP), and a phosphor screen (commonly called a screen, fiber-optic or anode). The photocathode detects a light image and converts the light image into a corresponding electron pattern. The MCP amplifies the electron pattern and the phosphor screen transforms the amplified electron pattern back to an enhanced light image.

Referring to FIG. 1, a current state of the art Generation III (GEN III) image intensifier tube 10 is shown. Examples of the use of such a GEN III image intensifier tube in the prior art are exemplified in U.S. Pat. No. 5,029,963 to Naselli, et al., entitled REPLACEMENT DEVICE FOR A DRIVER'S VIEWER and U.S. Pat. No. 5,084,780 to Phillips, entitled TELESCOPIC SIGHT FOR DAYLIGHT VIEWING. The GEN III image intensifier tube 10 shown, and in both cited references, is of the type currently manufactured by ITT Corporation, the assignee herein. In intensifier tube 10 shown in FIG. 1, infrared energy impinges upon photocathode 12. The photocathode 12 is comprised of glass faceplate 14 coated on one side with antireflection layer 16, a gallium aluminum arsenide (GaAlAs) window layer 17 and gallium arsenide (GaAs) active layer 18. Infrared energy is absorbed in GaAs active layer 18, thereby resulting in the generation of electron/hole pairs. The produced electrons are then emitted into vacuum housing 22 through a negative electron affinity (NEA) coating 20 present on GaAs active layer 18.

A microchannel plate (MCP) 24 is positioned within vacuum housing 22, adjacent NEA coating 20 of photocathode 12. Conventionally, MCP 24 is made of glass having a conductive input surface 26 and a conductive output surface 28. Once electrons exit photocathode 12, the electrons are accelerated toward input surface 26 of MCP 24 by a difference in potential between input surface 26 and photocathode 12 of approximately 300 to 900 volts. As the electrons bombard input surface 26 of MCP 24, secondary electrons are generated within MCP 24. The MCP 24 may generate several hundred electrons for each electron entering input surface 26. The MCP 24 is subjected to a difference in potential between input surface 26 and output surface 28, which is typically about 1100 volts, whereby the potential difference enables electron multiplication.

As the multiplied electrons exit MCP 24, the electrons are accelerated through vacuum housing 22 toward phosphor screen 30 by a difference in potential between phosphor screen 30 and output surface 28 of approximately 4200 volts. As is the electrons impinge upon phosphor screen 30, many photons are produced per electron. The photons create the output image for image intensifier tube 10 on the output surface of optical inverter element 31.

FIG. 2 is a schematic representation of image intensifier tube 41. The tube includes photocathode 54, microchannel plate (MCP) 53 and imaging sensor 56. Imaging sensor 56 can be any type of solid-state imaging sensor, such as a CCD device, or a CMOS imaging sensor.

Photocathode 54 can be, but is not limited to, a material such as GaAs, Bialkali, InGaAs, and the like. Photocathode 54 includes input side 54*a* and output side 54*b*. MCP 53 has a plurality of channels 52 formed between an input surface and an output surface.

An electric biasing circuit 44 provides a biasing current to image intensifier tube 41. Electric biasing circuit 44 includes a first electrical connection 42 and a second electrical connection 43. First electrical connection 42 provides a biasing voltage between photocathode 54 and MCP 53. Second electrical connection 43 applies a biasing voltage between MCP 53 and imaging sensor 56. In this configuration, photocathode 54, MCP 53, and imaging sensor 56 are maintained in a vacuum body or envelope 61 as a single unit, in close physical proximity to each other.

Still referring to FIG. 2, in operation, light 58, 59 from an image 57 enters image intensifier tube 41 through input side 54*a* of photocathode 54. Photocathode 54 changes the entering light into electrons 48, which are output from output side 54*b* of photocathode 54. Electrons 48 exiting photocathode 54 enter channels 52 of MCP 53. Secondary electrons are generated within the plurality of channels 52 of MCP 53. The MCP 53 may generate several hundred electrons in each of channels 52 for each electron entering through the input surface. Thus, the number of electrons 47 exiting channels 52 is significantly greater than the number of electrons 48 that entered channels 52. The intensified number of electrons 47 exit channels 52 and strike the electron receiving surface of imaging device 56. The imaging device transforms the electrons into a light image which may be stored in memory or viewed on display 46.

SUMMARY OF THE INVENTION

To meet this and other needs, and in view of its purposes, the present invention provides a photocathode for an image intensifier tube including a faceplate, a glass plate disposed opposite the faceplate, and a span having one end attached to the glass plate and the other end attached to the faceplate, for forming a sealed chamber between the faceplate and the glass plate. A semiconductor layer is bonded to a surface of the glass plate, where the surface is disposed outside of the sealed chamber. The semiconductor layer forms a photocathode. A thermal electric cooler (TEC) is disposed inside the sealed chamber for cooling the photocathode. The faceplate is an annular structure; the glass plate is an annular structure, and the span is an annular bracket extending between the glass plate and the faceplate for providing a separation distance between the faceplate and the glass plate. The faceplate is formed from a sapphire material, or other optically transparent material of high thermal conductivity. The glass plate is formed from high conductivity glass. The span is formed from either high conductivity glass or low conductivity glass. Preferably, the span is formed from low conductivity glass or other low conductivity material.

The faceplate and the glass plate form a path for light to impinge upon the semiconductor layer, and the photocathode of the semiconductor layer is configured to convert the light into electrons for emission toward an electron gain device. The electron gain device is a microchannel plate (MCP).

At least one cantilever bracket is attached to the glass plate at one end, and forms a seat for the annular TEC at another end. The at least one cantilever bracket is formed of copper material to provide thermal conductivity between the TEC and the glass plate. The seat includes an indentation formed in the at least one cantilever bracket for receiving the annular TEC. The at least one cantilever bracket is bonded at an end to the glass plate. Standoffs are formed on top of the glass plate for providing a separation distance between the glass plate and the opposing faceplate.

Another embodiment of the present invention is a photocathode structure having a sealed chamber formed by walls, a bottom wall providing an exterior surface to the sealed chamber, a photocathode layer disposed on the exterior surface, and a TEC disposed within the sealed chamber for cooling the photocathode layer. The TEC is in thermal contact with the photocathode layer by way of high conductivity material. The high conductivity material includes glass and at least one copper bracket attached to the glass.

Yet another embodiment of the present invention is an image intensifier tube including a photocathode structure, an electron sensing device, and an electron gain device disposed between the electron sensing device and the photocathode structure. The photocathode structure includes: a sealed chamber formed by walls, a bottom wall providing an exterior surface to the sealed chamber, a photocathode layer disposed on the exterior surface, and a TEC disposed within the sealed chamber for cooling the photocathode layer. The TEC is in thermal contact with the photocathode layer by way of a high conductivity material, which includes glass and at least one copper bracket attached to the glass.

It is understood that the foregoing general description and the following detailed description are exemplary, but are not restrictive, of the invention.

BRIEF DESCRIPTION OF THE FIGURES

The invention may be understood from the following detailed description when read in connection with the following figures.

DETAILED DESCRIPTION OF THE INVENTION

The present invention provides a photocathode structure that is cooled in temperature to reduce generation of dark currents. It is known that a photocathode generates dark currents, when its temperature increases during operation in an image intensifier tube or in a solid state image intensifier. The dark currents of the photocathode is temperature dependent. Lowering the temperature is one method of reducing dark currents.

Figure 1:
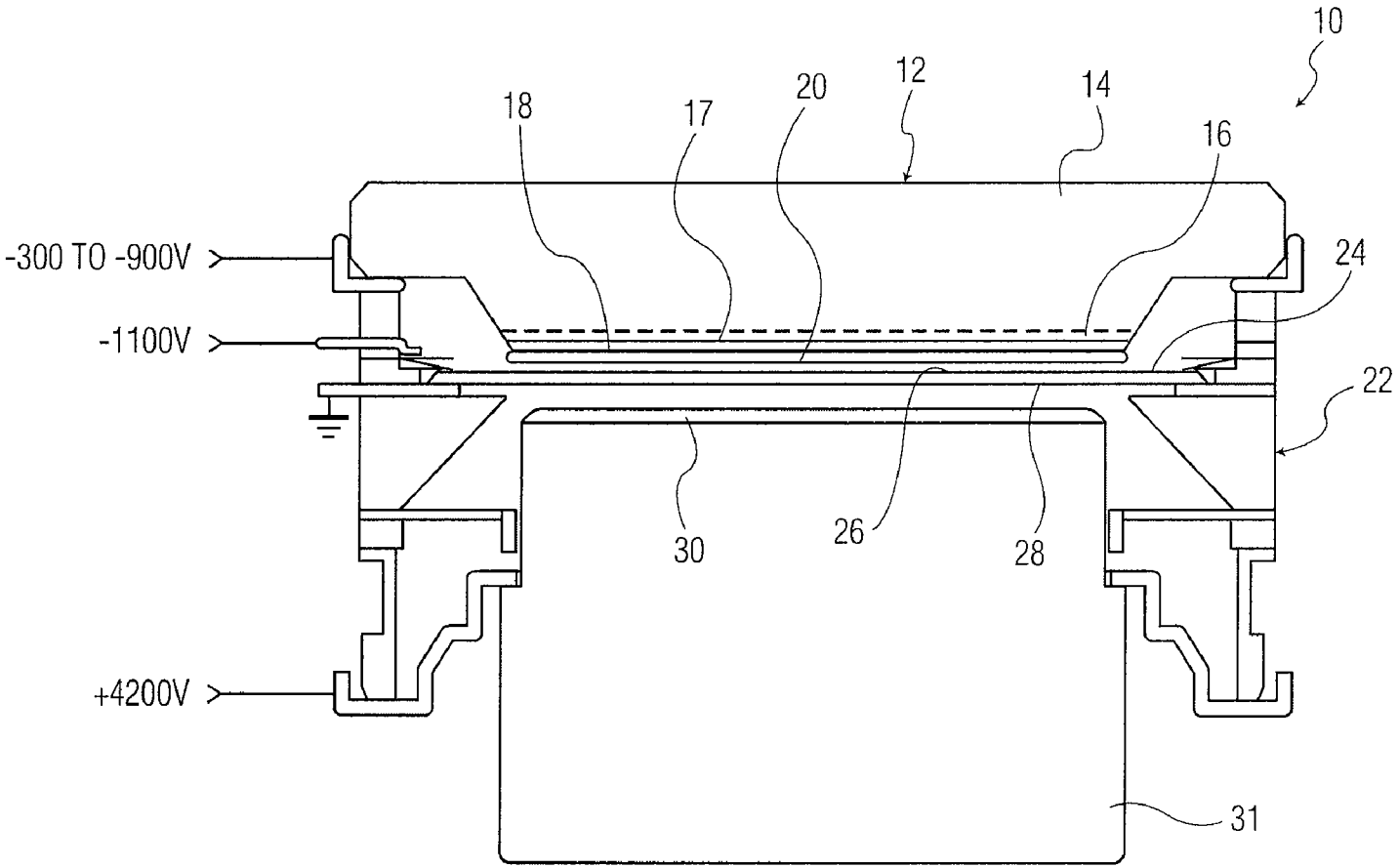
FIG. 1 PRIOR ART
FIG. 1 is a cross-sectional diagram of a conventional image intensifier tube.

Lowering the temperature, however, requires electrical power, whose usage is preferably minimized, especially during operation of a night vision goggle device. In conventional photocathodes (such as shown in FIG. 1), the entire image intensifier system is cooled, by immersing the device in an exterior tube. The exterior tube results in an inefficient usage of electrical power, because a large mass is required to be temperature cooled. For example, the tube body, the MCP and the photo-anode structure are unnecessarily cooled.

As will be explained, the present invention advantageously concentrates on cooling primarily only the photocathode structure. The present invention advantageously uses a vacuum formed between the photocathode structure and the MCP to obtain a high thermal resistance, so that the amount of heat re-entering the photocathode structure is reduced. The present invention also reduces the amount of material comprising the photocathode structure, in order to reduce the number of paths for re-entrant heat flowing into the photocathode structure. Furthermore, the present invention replaces the reduced amount of material comprising the photocathode with a vacuum, which forms a high thermal resistance.

Figure 3:
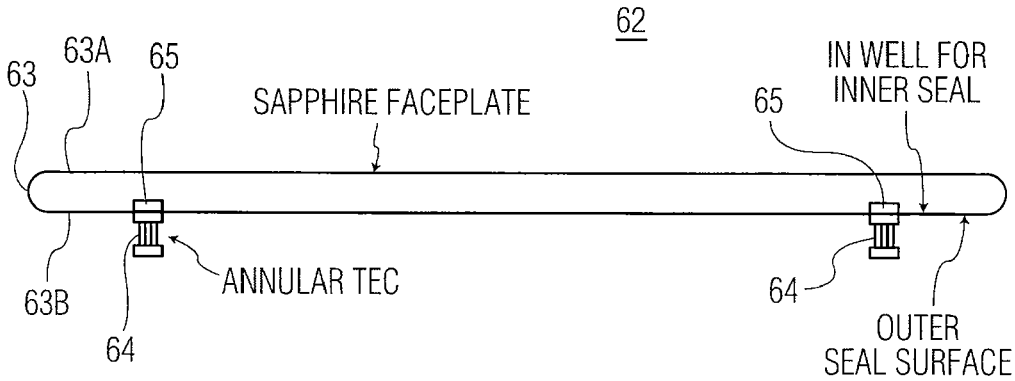
FIG. 3 is a cross-sectional diagram of a first set of components used in assembling a photocathode structure, in accordance with an embodiment of the present invention.
Figure 4:
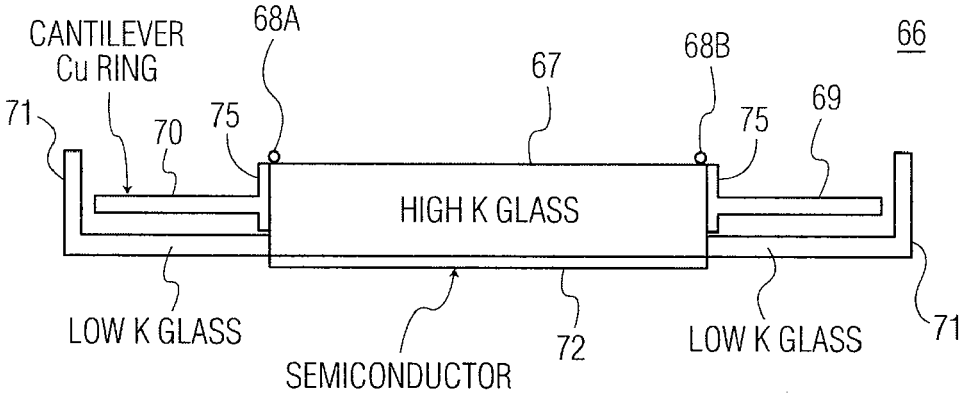
FIG. 4 is a cross-sectional diagram of a second set of components used for assembling a photocathode structure, in accordance with an embodiment of the present invention.
Figure 5:
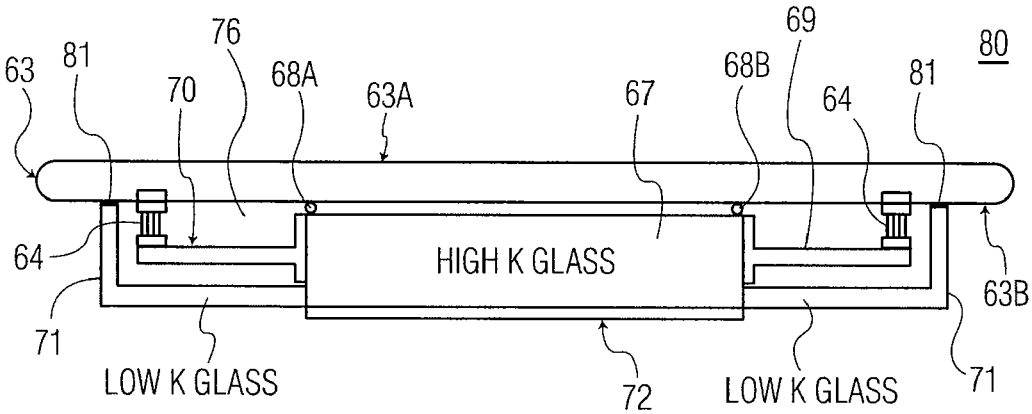
FIG. 5 is a cross-sectional diagram of an assembled photocathode structure, using the sets of components shown in FIGS. 3 and 4, in accordance with an embodiment of the present invention.

Referring now to FIGS. 3, 4 and 5, there is shown a cooled photocathode structure, in accordance with an embodiment of the present invention. FIGS. 3 and 4 show two separate sets of components of the photocathode structure and FIG. 5 shows an integrated and assembled photocathode structure.

Referring first to FIG. 3, there is shown a first set of components of a photocathode structure, generally designated as 62. The first set of components is comprised of faceplate 63 and a thermal electric cooler (TEC) 64. The faceplate 63 may be formed from sapphire material, for example, and may have an annular cross-section. The top annular surface of faceplate 63 is designated as 63A and the bottom annular surface is designated as 63B. It will be appreciated that faceplate 63 may be formed of any material having a high thermal conductivity (which, for example, may be greater than or equal to 33 W/m/k) and of any material providing a transparent window for light passing from top surface 63A to bottom surface 63B.

As shown in cross-section in FIG. 3, TEC 64 forms an annular ring. It will be appreciated, however, that TEC 64 may be one or more thermal coolers soldered or fastened to bottom surface 63B of faceplate 63, and does not need to be annular in shape. The one or more TECs 64 may be attached directly to the bottom surface of faceplate 63 using only one electrically insulating annular ceramic ring (not shown).

The faceplate 63 may include two contact ports for TEC power (not shown) and two contact ports for a thermistor (not shown). The thermistor may be used to control the on/off operation of the one or more TECs. The contact ports may be formed by drilling into faceplate 63. The contact ports may be formed by a recess in the bottom surface of faceplate 63, as shown by recess 65 in the faceplate. Of course, for an annular TEC, recess 65 may also be annular to completely receive the TEC. An indium sealant may be used for sealing any openings in recessed section 65 between the TEC and the faceplate. A high temperature solder material may also be used for assembling the TEC (one or more) with the faceplate.

It will be appreciated that a non-evaporable getter may be placed on the bottom surface of faceplate 63.

Referring next to FIG. 4, there is shown a second set of components of a photocathode structure, generally designated as 66. The second set of components is comprised of glass plate 67, span 71, one or more cantilevered brackets 69, 70, and semiconductor layer 72.

The span 71 and glass plate 67 may be formed from one type of glass or from two types of glass. As shown in FIG. 4, glass plate 67 is formed as a glass disk using high conductivity glass and span 71 is formed as an "L" shape using low conductivity glass. The glass plate 67 is bonded to span 71 forming a single "U" shape, when viewed in cross-section. As another embodiment, glass plate 67 and span 71 may be formed from one type of glass having high or low thermal conductivity.

As an example, the high conductivity glass may be BK7 having a thermal conductivity of 1.3 W/m/k. The low conductivity glass may have a thermal conductivity of 0.3 W/m/k. It is important, of course, that glass plate 67 be made from glass or other material that provides a transparent window for light to pass through the glass and impinge on semiconductor layer 72, the latter converting the light into electrons.

Figure 2:
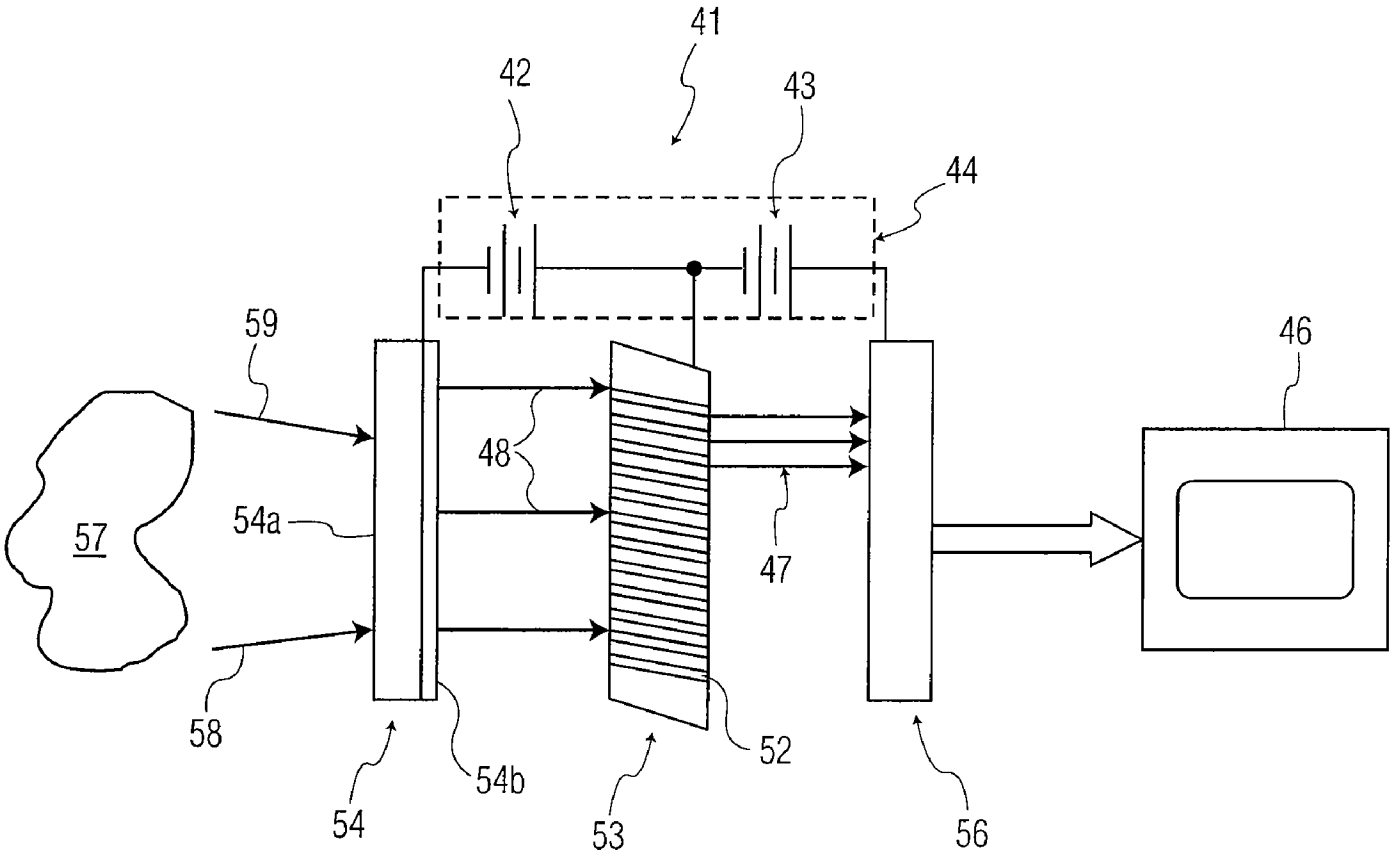
FIG. 2 PRIOR ART
FIG. 2 is a functional block diagram of a conventional image intensifier system.

The semiconductor layer 72 is bonded to glass plate 67 for providing the photocathode transformation of light (photons) into electrons. The electrons, of course, are then provided as an input to an MCP (such as MCP 53 shown in FIG. 2). The semiconductor layer may include an active layer such as gallium arsenide (GaAs) and additional layers, such as an antireflection layer, a window layer of gallium aluminum arsenide (GaAlAs) and a negative electron affinity (NEA) coating disposed on the GaAs active layer (as described with respect to FIG. 1).

It will be appreciated that after forming glass plate 67 and span 71, the formed glass may be ground and polished. The semiconductor layer 72 is then bonded to glass plate 67. Next, in a possible fabrication sequence, the surface of glass plate 67, which is opposite to semiconductor layer 72 may be further ground and polished. The cantilevered brackets (one or more) may be finally attached to glass plate 67.

As shown in FIG. 4, cantilevered brackets 69, 70 are bonded to the end disk surface of glass plate 67. The bonding may be performed using frit or solder, for example. The cantilevered brackets may be formed of any conductive material having high thermal conductivity, such as copper. The cantilevered brackets may be formed as separate sections, as best shown in FIG. 6B, and attached to the disk surface of glass plate 67 by way of a ring, as shown in FIG. 4 designated as 75. The ring 75 may be formed of materials identical to cantilevered brackets 69, 70. It will be understood that ring 75 and cantilevered brackets 69, 70 may be a single piece of copper, for example.

If made from a deformable material, such as copper, cantilevered brackets 69, 70 may be notched or recessed at their end portions to receive, hold or lock TEC 64, as shown in FIG. 5.

The final assembly of the first and second sets of components 62 and 66 into an integrated photocathode structure is shown in FIG. 5, where the integrated photocathode structure is designated as 80. In preparation for assembly, first set of components 62 (FIG. 3) and second set of components 66 (FIG. 4) may be subjected separately to a UHV (ultra-high vacuum) process. The first set of components 62 may undergo reduced temperature processing, whereas the second set of components 66 may be subjected to processing in a full temperature range. The reverse, however, may also be true.

The first and second sets of components may be press fitted during the UHV process using an indium bond to form a sealed evacuated chamber. The indium bond is designated as 81 and the sealed chamber is designated as 76, as shown in FIG. 5. Two or more standoffs 68A, 68B may be provided on top of the disk end of glass plate 67 for supporting faceplate 63.

The cantilevered brackets 69, 70 provide support for TEC 64, as shown in FIG. 5. Although not shown, it will be appreciated that the cantilevered brackets may be notched or recessed to receive and hold TEC 64 in position. A bond may not be necessary to lock TEC 64 to cantilevered brackets 69, 70. During the sealing process of first and second sets of components 62 and 66, the cantilevered brackets may flex and take pressure away from TEC 64. The flexing is very noticeable, when the cantilevered brackets and ring 75 are formed from a single piece of copper.

Figure 6A:
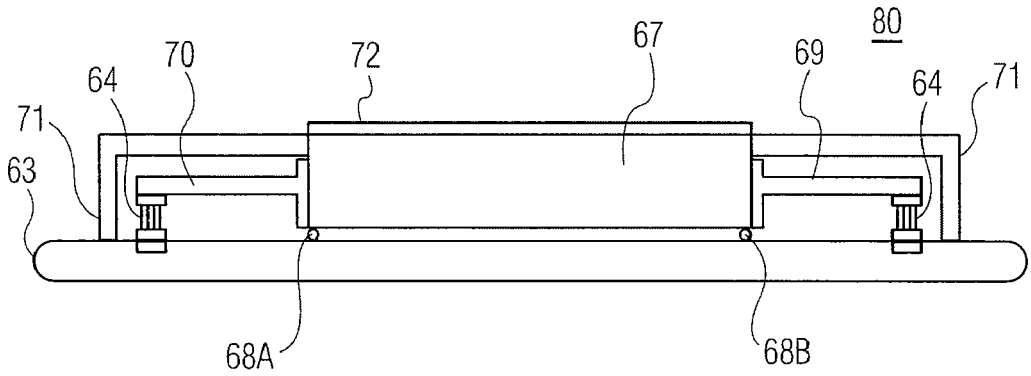
FIGS. 6A, 6B and 6C are cross-sectional diagrams and perspective diagrams, respectively, showing portions of an assembled photocathode structure, in accordance with an embodiment of the present invention.
Figure 6B:
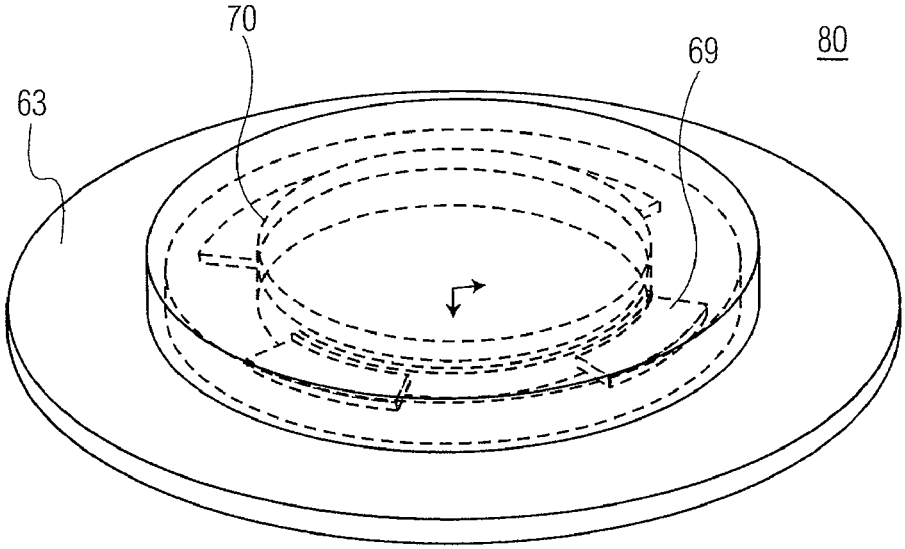
Figure 6C:
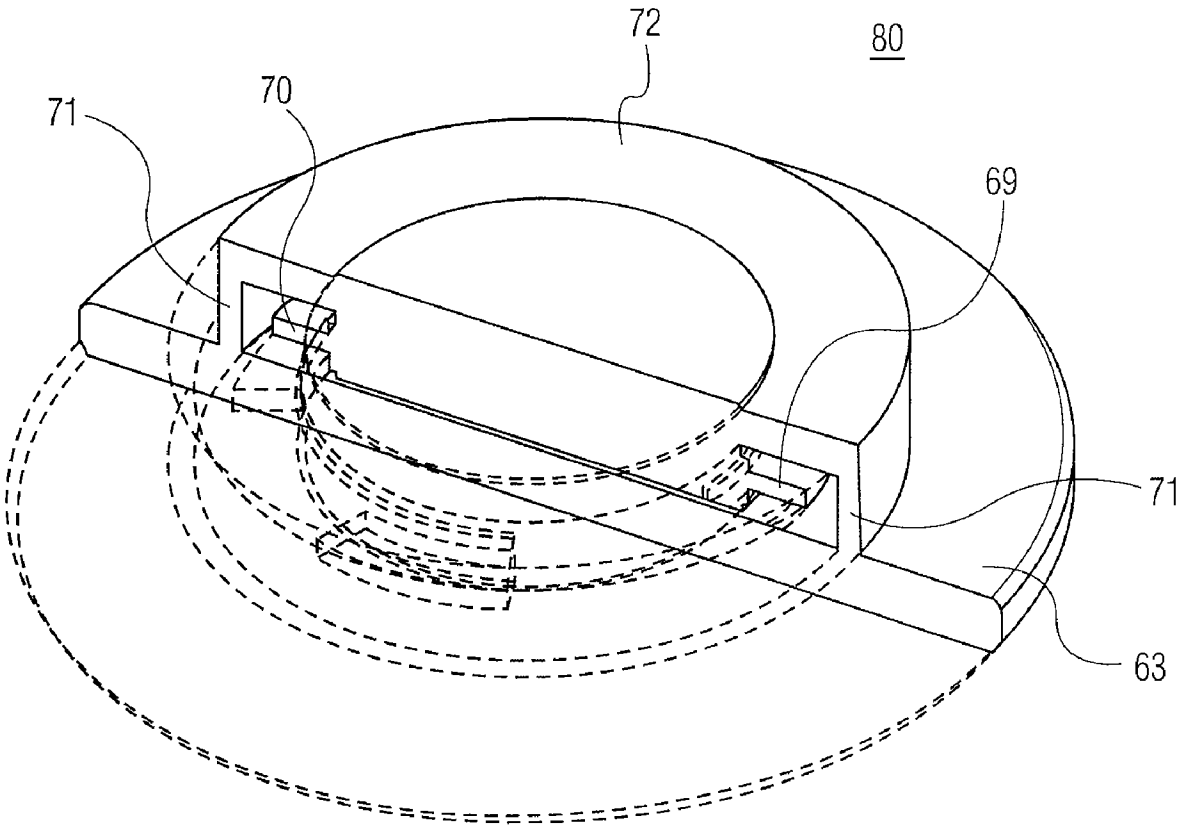

Referring next to FIGS. 6A, 6B and 6C, there is shown an assembled photocathode structure 80. FIG. 6A is similar to FIG. 5, except that the photocathode structure is shown upside down. FIG. 6B is a perspective view of photocathode structure 80, with TEC 64 and span 71 (FIG. 6A) not shown. FIG. 6C is a cut-away view of photocathode structure 80, with TEC 64 not shown.

Figure 7:
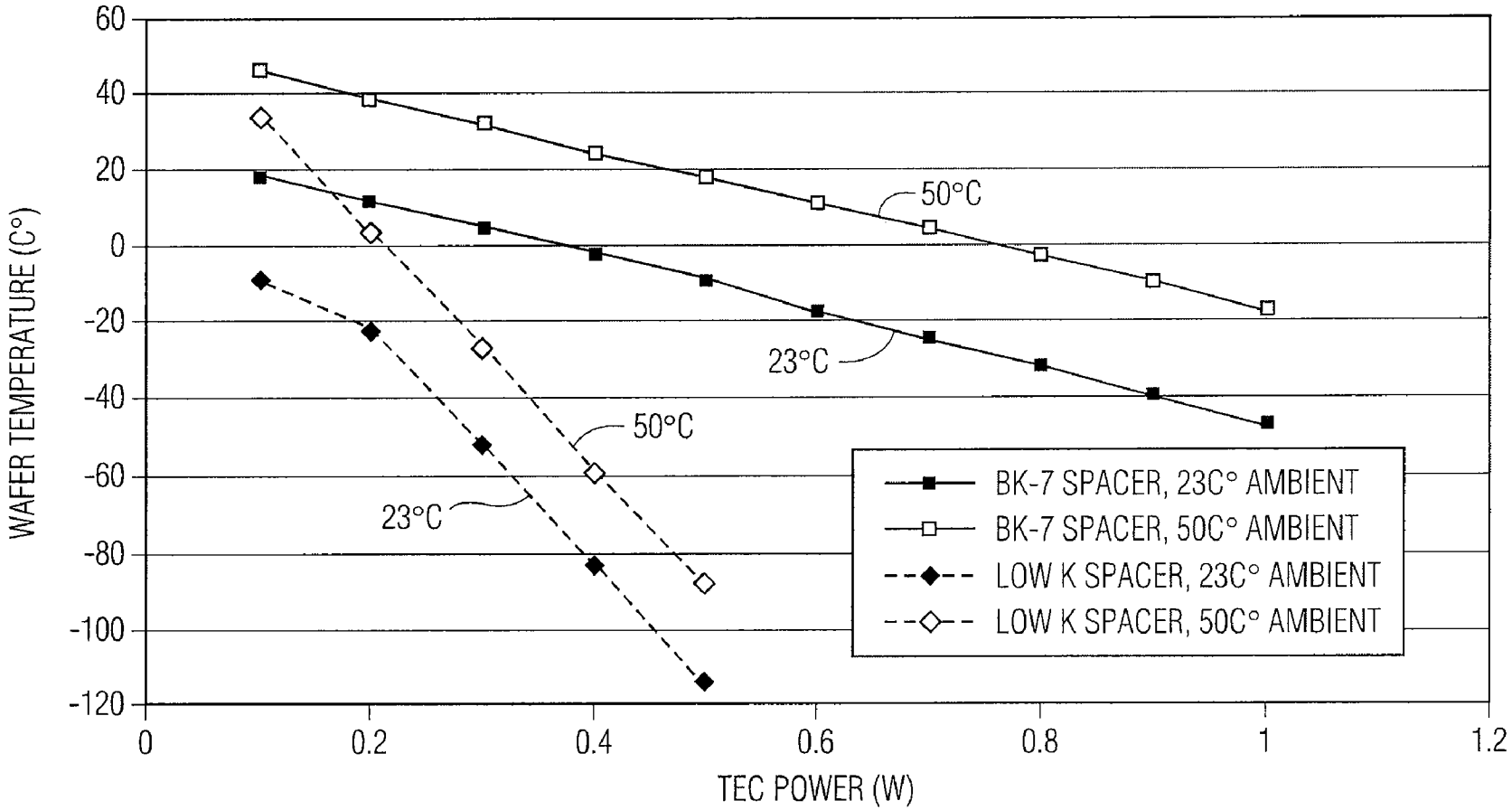
FIG. 7 is a plot of wafer temperature versus TEC power, showing performance results of using an embodiment of the present invention.

FIG. 7 is a plot of wafer temperature)(C.°) versus TEC power (W). The two solid curves having the legend of "BK-7 spacer" implies that glass plate 67 and span 71 are formed from a single high thermally conductive material, such as BK-7. The two dashed curves having the legend of "low K spacer" implies that glass plate 67 is formed from a high thermally conductive material and span 71 is formed from a low thermally conductive material. The curves shown in FIG. 7 are results of simulation taken at two different ambient temperatures (23° C. and 50° C.). It will be appreciated that the "low K spacer" (2 materials) provides a lower temperature than the "BK-7 spacer" for a fixed TEC power usage.

Accordingly, the present invention provides a low power method of cooling the photocathode by incorporating the TECs into a vacuum environment, such as chamber 76. The vacuum chamber 76 is separate from photocathode layer 72, in order to prevent poisoning of the photocathode surface, because the TEC cannot be processed at a high temperature.

Some penalty is paid by the present invention, due to an increased diameter of the cathode, which may be traded off between power usage versus size. In general terms, photocathode structure 80 may be sized for insertion into housing 22 of image intensifier tube 10 shown in FIG. 1. Of course, photocathode structure 12 is replaced by photocathode structure 80 of the present invention.

It will be observed that the vacuum chamber of photocathode structure 80 is separate from the vacuum chamber of housing 22, in which the photocathode layer, MCP 24 and the input surface of anode 31 reside.

Although the invention is illustrated and described herein with reference to specific embodiments, the invention is not intended to be limited to the details shown. Rather, various modifications may be made in the details within the scope and range of equivalents of the claims and without departing from the invention.

What is claimed is:

1. A photocathode for an image intensifier tube comprising a faceplate, a glass plate disposed opposite the faceplate, a span having one end attached to the glass plate and the other end attached to the faceplate, for forming a sealed chamber between the faceplate and the glass plate, and a semiconductor layer bonded to a surface of the glass plate, the semiconductor layer disposed outside of the sealed chamber, wherein the semiconductor layer transforms light into electrons, a thermal electric cooler (TEC) is disposed completely inside the sealed chamber for cooling the semiconductor layer, at least one cantilever bracket is attached to the glass plate at one end, and the cantilever bracket forms a seat for holding the TEC at another end, the cantilever bracket and the span each extend away from the glass plate and do not touch each other, and the cantilever bracket provides direct thermal conduction between the TEC and the glass plate.

2. The photocathode of claim 1 wherein the faceplate is an annular structure, the glass plate is an annular structure, and the span is an annular bracket extending between the glass plate and the faceplate for providing a separation distance between the faceplate and the glass plate.

3. The photocathode of claim 1 wherein the faceplate is formed from sapphire material.

4. The photocathode of claim 1 wherein the faceplate and the glass plate form a path for light to impinge upon the semiconductor layer, and the semiconductor layer is configured to convert the light into electrons for emission toward an electron gain device.

5. The photocathode of claim 4 wherein the electron gain device is a microchannel plate (MCP).

6. The photocathode of claim 1 wherein the at least one cantilever bracket is formed of copper material to provide thermal conductivity between the TEC and the glass plate.

7. The photocathode of claim 1 wherein the seat includes an indentation formed in the at least one cantilever bracket for receiving the annular TEC.

8. The photocathode of claim 1 wherein the at least one cantilever bracket is bonded at an end to the glass plate.

9. The photocathode of claim 1 wherein the sealed chamber is a vacuum.

10. The photocathode of claim 1 including standoffs formed on top of the glass plate for providing a separation distance between the glass plate and the opposing faceplate.

* * * * *